US007063293B2

(12) United States Patent
Leitner et al.

(10) Patent No.: US 7,063,293 B2
(45) Date of Patent: Jun. 20, 2006

(54) ROLLING DEVICE FOR A DISPLACEABLE CROSS FROG

(75) Inventors: Josef Leitner, Weisskirchen (AT); Hannes Feldbaumer, Kleinlobming (AT); Franz Stelzer, Vienna (AT)

(73) Assignees: VAE Eisenbahnsysteme GmbH, Zeltweg (AT); VAE GmbH, Vienna (AT)

( * ) Notice: Subject to any disclaimer, the term of this patent is extended or adjusted under 35 U.S.C. 154(b) by 0 days.

(21) Appl. No.: 10/511,379

(22) PCT Filed: Apr. 23, 2003

(86) PCT No.: PCT/AT03/00117

§ 371 (c)(1),
(2), (4) Date: Oct. 14, 2004

(87) PCT Pub. No.: WO03/091501

PCT Pub. Date: Nov. 6, 2003

(65) Prior Publication Data

US 2005/0161555 A1 Jul. 28, 2005

(30) Foreign Application Priority Data

Apr. 23, 2002 (AT) ..... A 628/2002

(51) Int. Cl.
*E01B 7/00* (2006.01)

(52) U.S. Cl. ..... 246/453

(58) Field of Classification Search ..... 246/453, 246/392, 380, 430, 415 R
See application file for complete search history.

(56) References Cited

U.S. PATENT DOCUMENTS

| | | | |
|---|---|---|---|
| 5,501,418 | A | 3/1996 | Humphrey et al. |
| 5,628,480 | A | 5/1997 | Vrsecky et al. |

FOREIGN PATENT DOCUMENTS

| | | | |
|---|---|---|---|
| EP | 0 389 851 | A1 | 10/1990 |
| EP | 0 692 570 | A1 | 1/1996 |
| EP | 0 740 021 | A1 | 10/1996 |
| EP | 1 055 778 | A2 | 11/2000 |
| WO | WO 94/26976 | | 11/1994 |
| WO | WO 01/06060 | A1 | 1/2001 |

*Primary Examiner*—Mark T. Le
(74) *Attorney, Agent, or Firm*—Chapman and Cutler LLP

(57) ABSTRACT

In a roller device (6,7) for a movable point of frog (1), including a sliding strip (18) and at least one roller (11) and at least one roller bearing (12) fixed to a stationary part of the switch, the roller(s) (11) is/are mounted on an arm (19) of a double-armed lever (10). The pivot bearing (12) of the lever (10) is arranged in a support (13) connected with a stationary part of the switch, wherein the arm (18) facing away from the roller(s) (11), of the double-armed lever (10) is pivotable against a spring (19) with adjustable spring power.

23 Claims, 2 Drawing Sheets

ROLLING DEVICE FOR A DISPLACEABLE CROSS FROG

The invention relates to a roller device for a movable point of frog, including a sliding strip and at least one roller and at least one roller bearing fixed to a stationary part of the switch.

A device of this type is, for instance, known from WO 94/26976 A1. In that known roller device, an element comprising a projection extending along, or approximately along, the central axis of the point of frog departs directly or indirectly from the point of frog on the side of the foot, wherein said element interacts with a roller element whose central axis extends in, or approximately in, a symmetrical plane extending between the wing rail. In that known device, the roller guide on which the roller rolls off is, thus, directly or indirectly connected with the point of frog, whereby the respective roller is supported by a structure fixed to the side rails. The roller device known from WO 94/26976 A1 serves to support the point of frog at a switching movement from one abutment position into the other. In order to cause the point of frog to be lifted from the slide chair during such switching movement, the roller guide in that case comprises two outer, concavely extending portions and a central, preferably plateau-shaped portion on its surface facing the roller. On the roller guide connected with the point of frog, a guide track is thus provided, which is configured in a manner that the point of frog is lifted from the slide chair as the guide track slides over the roller element.

Similar roller devices have also become known for tongue rails, wherein a roller device in which the roller cooperates with spring elements may, for instance, be taken from WO 94/02682 A1. It has, however, turned out that the known roller devices are not readily suitable for the subsequent installation into existing track systems.

For the purpose of creating a roller device for a movable point of frog, which can be readily installed into an existing system even subsequently without involving any cumbersome adaptation or adjustment work at the existing rails and, in particular, the point of frog and wing rails or side rails, it was proposed in the earlier application A 1429/2001 to mount the roller in a roller holder connected with the point of frog and to connect the roller guide with the wing rails and, in particular, the rail foot, or with the ground plate. By such a proposal the subsequent mounting of the roller device was substantially facilitated due to the fact that, unlike in known configurations, the roller holder was directly connected with the point of frog and the roller was thus attached to the point of frog. Yet, any fine-tuning is still relatively expensive, calling for a huge number of precisely adapted structural components. In particular, it is not readily feasible in that earlier configuration to realize an appropriate resilient support in a simple manner.

The present inventions aims to further simplify the installation of a roller device for a movable point of frog and, at the same time, render feasible the provision of an appropriate support of the point of frog on several points along the axial lengths of the point of frog with a minimum of adjustment work and, in particular, by using identical spring elements. To solve this object, the configuration according to the invention consists essentially in that the roller(s) is/are mounted on an arm of a double-armed lever, that the pivot bearing of the lever is arranged in a support connected with a stationary part of the switch, and that the arm facing away from the roller(s), of the double-armed lever is pivotable against a spring with adjustable spring power. Due to the fact that the rollers are mounted on an arm of a double-armed lever with the pivot bearing of the lever being arranged in a support connected with a stationary part of the switch, it is feasible in a particularly simple manner to subsequently simply fix the respective support in order to simply insert the double-armed lever laterally, thus substantially facilitating its installation. Due to the fact that the arm facing away from the roller or rollers, of the double-armed lever is pivotable against a spring with adjustable spring power, it is feasible in a simple manner to define the desired spring power, the adjustability of the spring power being readily feasible without impediment outside the region of the movable point of frog. If, as in accordance with a preferred embodiment of the roller device according to the invention, the configuration is devised such that the lever arm ratio of the double-armed levers of a switch is each selected to be identical and the respectively shorter lever arm carries the roller(s), it will consequently be feasible for roller devices neighboring in the longitudinal direction of the frog to employ identical spring elements, with the identical setting force being each applicable to adjust said spring force. It is, therefore, not necessary to define different spring elements as a function of the installation situation, and the same setting paths and same setting forces will each be used in any installation position. In this manner, particularly simple adjustment and hence particularly safe subsequent mounting will be ensured in the event of subsequent mounting.

As already mentioned, the fixation of the support in a particularly simple manner may be effected to the supporting structure for the movable point of frog outside the region of the wing rails. The configuration in this respect in a particularly advantageous manner is devised such that the support is fixed to the wing rails or the supporting structure of the switch, and that the adjustment device for the spring in top view is arranged outside the wing rails or the supporting structure, respectively, wherein the pivot bearing of the lever is provided in a substantially U-shaped support and, in particular, in or on the side cheeks of said support. Such a support which is substantially U-shaped in cross section and whose side cheeks carry the pivot bearings of the lever allows for the insertion of the double-armed lever in the longitudinal direction of the U-shaped support, and hence transverse to the longitudinal direction of the rails, and the pivotal fixation of the same in its respective position in a particularly simple manner. For fine tuning it will, thus, be sufficient to position the pivotable lever accordingly and, after this, adjust the spring to the value that will be identical for all positions, as a function of the lever ratio. In this respect, the configuration may advantageously be devised such that the lever arm ratio is 2:3 to 1:3, preferably 1:2, so that relatively small-structured springs will do.

In order to enable the selection of an accordingly favorable position for the spring with adjustable spring force irrespective of the respective installation situation of the support, it is feasible to design the double-armed levers each having the same lever arm ratio differently for different installation conditions. In that case, it may be of particular advantage to devise the configuration in a manner that the lever arm is designed to be cranked, whereby the individual roller devices as a function of the structural length of the movable points of frog may be designed to be substantially identical in terms of structure except for the lever length. The adjustment device required for the adjustment of the spring force may each be positioned where particularly easy handling is provided.

In the following, the invention will be explained in more detail by way of an exemplary embodiment schematically illustrated in the drawing. Therein, FIG. 1 is a ground plan of a switch portion including a movable point of frog;

Figure 1:
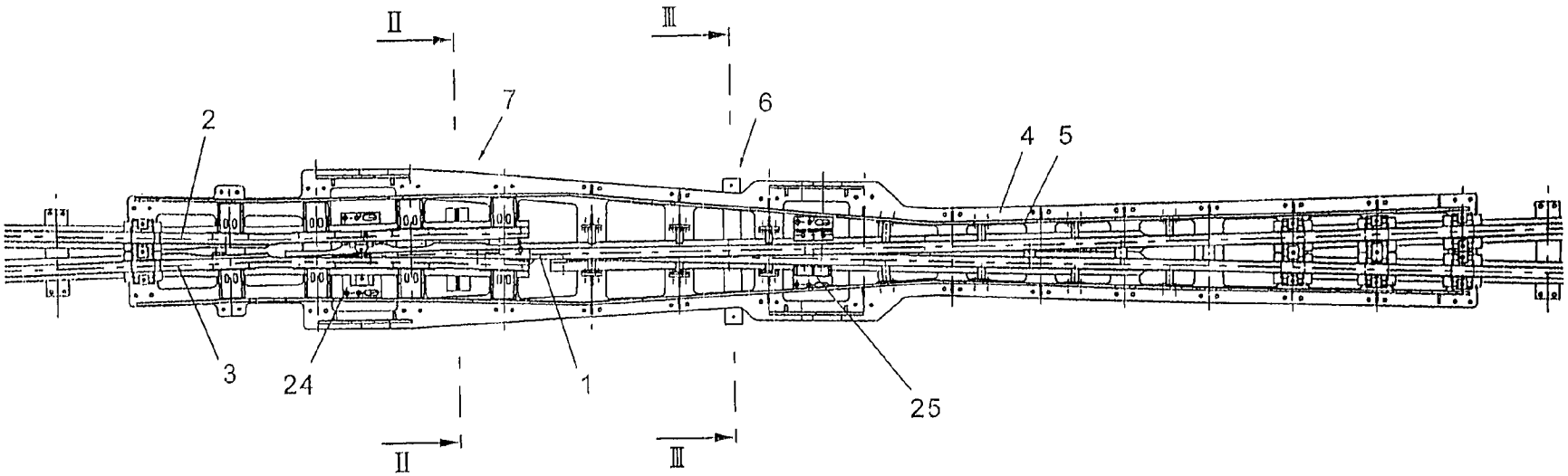

FIG. 1 illustrates a frog with a point of frog 1 as well as wing rails 2 and 3. Furthermore, a ground plate 4 including a reinforcement frame 5 and the two locking arrangements 24 and 25 are apparent. The roller devices according to the invention are denoted by 6 and 7, respectively, wherein, as is apparent from the views according to FIG. 2 and FIG. 3, the roller device 7 is fixed to the wing rails 2 and 3 by the aid of a supporting structure and the roller device 6 is fixed to the ground plate 4 after the runout of the wing rails.

Figure 2:
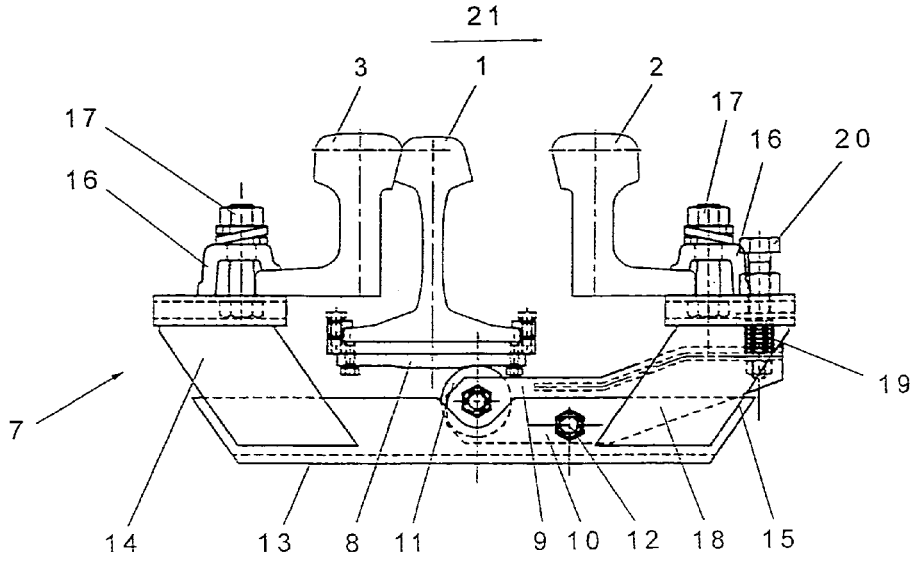
FIG. 2 is a section along line II/II of FIG. 1.

FIG. 2 depicts the roller device 7, wherein the point of frog 1 is in abutment on the wing rail 3 and a slide strip 8 is connected with the foot of the point of frog 1, said slide strip 8 cooperating with a roller 11 mounted on an arm 9 of a double-armed lever 10. The double-armed lever 10, by means of a pivot bearing 12, is pivotally mounted in a stationary U-shaped support 13 which is clamped to the wing rails 2 and 3 via brackets 14 and 15 as well as the clamping elements 16 and screw bolts 17. The arm 18 facing away from the roller 11, of the double-armed lever 10 is mounted so as to be pivotable against the spring 19, the spring force of the spring 19 being adaptable to the respective requirements by the aid of an adjustment bolt 20.

Departing from the position of the point of frog 1 illustrated in the drawing, in which the point of frog 1 abuts on the wing rail 3 and the point of frog 1 abuts on the roller 11 via the smaller-height portion of the slide strip 8, the point of frog 1 is lifted from the bearing plate at a switching movement in the sense of arrow 21 by the ramp formed on the slide strip running onto the roller 11 and thus abutting on the same by its larger-height portion. The switching movement of the point of frog 1 is thereby facilitated and the wear minimized. As the point of frog 1 approaches the wing rail 2, the roller 11 reaches again the smaller-height region of the slide strip via the ramp illustrated on the left-hand side of the drawing so as to cause the point of frog 1 to abut on the wing rail 2 and rest again on the ground plate.

Figure 3:
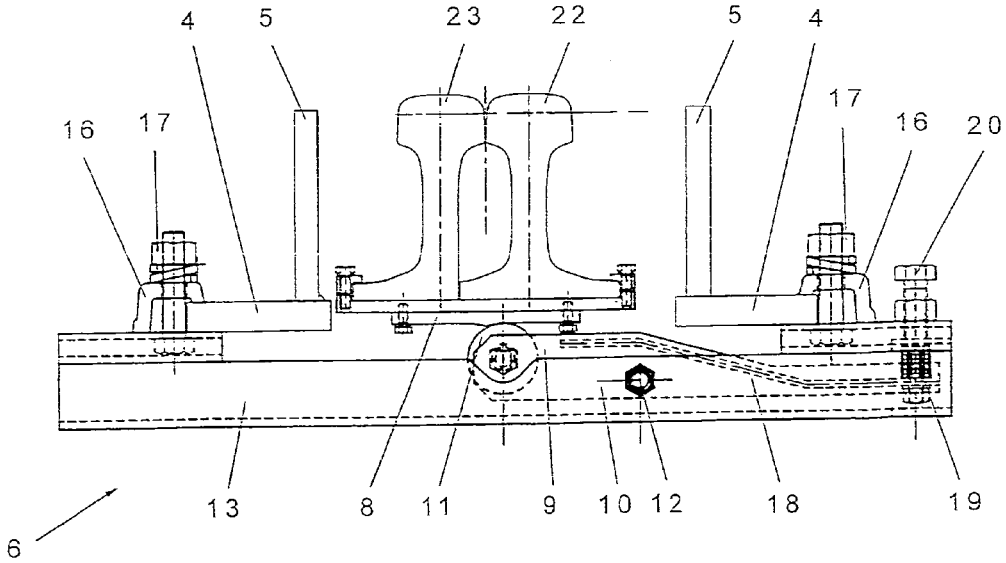
FIG. 3 is a section along line III/III of FIG. 1.

FIG. 3 depicts the roller device 6, which, as opposed to the roller device 7, is not fixed to the wing rails but to the ground plate 4. In the region of the arrangement of the roller device 6, the switching movement of the point of frog occurs over a smaller switching path, and the shape of the guiding path on the slide strip 8 is, therefore, adapted to the reduced displacement path. The point of frog 1 in this region is comprised of the main point 22 and the side point 23. As for the rest, the reference numerals used in FIG. 2 have been retained for identical parts.

The invention claimed is:

1. A roller device for a movable point of frog, comprising a sliding strip, a double-armed lever(10), said double-armed lever (10) being pivotable about a pivot bearing (12) arranged in a support (13) connected with a stationary part of a switch, said double-armed lever (10) comprising a first arm (9) and a second arm (18), and at least one roller (11) mounted on the first arm (9) of said double-armed lever (10), wherein said second arm (18) faces away from said at least one roller (11) and is pivotable against a spring (19) with adjustable spring power, and wherein said pivot bearing (12) is arranged between said spring (19) and said at least one roller (11).

2. A roller device according to claim 1, wherein the pivot bearing (12) of the lever (10) is arranged in a substantially U-shaped support (13).

3. A roller device according to claim 2, wherein the support (13) is fixed to wing rails (2,3) or to supporting structure (4,5) of the switch, and an adjustment device (20) for the spring (19) in top view is arranged outside the wing rails (2,3) or the supporting structure (4,5), respectively.

4. A roller device according to claim 2, wherein a lever arm ratio of the double-armed lever (10) is 2:3 to 1:3.

5. A roller device according to claim 2, wherein the second lever arm (18) is designed to be cranked.

6. A roller device according to claim 1, wherein a lever arm ratio of the double-armed lever (10) is 2:3 to 1:3.

7. A roller device according to claim 6, wherein the support (13) is fixed to wing rails (2,3) or to supporting structure (4,5) of the switch, and an adjustment device (20) for the spring (19) in top view is arranged outside the wing rails (2,3) or the supporting structure (4,5), respectively.

8. A roller device according to claim 6, wherein the second lever arm (18) is designed to be cranked.

9. A roller device according to claim 1, wherein the second lever arm (18) is designed to be cranked.

10. A roller device according to claim 9, wherein the support (13) is fixed to wing rails (2,3) or to supporting structure (4,5) of the switch, and an adjustment device (20) for the spring (19) in top view is arranged outside the wing rails (2,3) or the supporting structure (4,5), respectively.

11. A roller device according to claim 1, wherein the support (13) is fixed to wing rails (2,3) or to supporting structure (4,5) of the switch, and an adjustment device (20) for the spring (19) in top view is arranged outside the wing rails (2,3) or the supporting structure (4,5), respectively.

12. A roller device according to claim 1, wherein the pivot bearing (12) of the lever (10) is arranged in or on side cheeks of said support (13).

13. A roller device according to claim 12, wherein a lever arm ratio of the double-armed lever (10) is 2:3 to 1:3.

14. A roller device according to claim 12, wherein the support (13) is fixed to wing rails (2,3) or to supporting structure (4,5) of the switch, and an adjustment device (20) for the spring (19) in top view is arranged outside the wing rails (2,3) or the supporting structure (4,5), respectively.

15. A roller device according to claim 12, wherein the second lever arm (18) is designed to be cranked.

16. A roller device according to claim 1, wherein a lever arm ratio of the double-armed lever (10) is 1:2.

17. A roller device according to claim 16, wherein the second lever arm (18) is designed to be cranked.

18. A roller device according to claim 16, wherein the support (13) is fixed to wing rails (2,3) or to supporting structure (4,5) of the switch, and an adjustment device (20) for the spring (19) in top view is arranged outside the wing rails (2,3) or the supporting structure (4,5), respectively.

19. A set of roller devices for a movable point of frog, comprising a plurality of roller devices, wherein each roller device comprises a sliding strip, at least one roller (11), and at least one roller bearing fixed to a stationary part of a switch, wherein said at least one roller is mounted on a first arm (9) of a double-armed lever (10), a pivot bearing (12) of the lever (10)is arranged in a support (13) connected with a stationary part of the switch, said pivot bearing (12) defining a pivot axis for the pivoting motion of said lever (10), and a second arm (18) of the double-armed lever (10) facing away from the at least one roller (11) is pivotable against a spring (19) with adjustable spring power, wherein said plurality of roller devices is arranged in a manner offset in a longitudinal direction of said movable point of frog, wherein a lever arm ratio of said double-armed lever (10) of each of said plurality of roller devices is selected to be identical, and the first lever arm (9) of each of the plurality of roller devices is respectively shorter than the second lever arm (18), and carries the at least one roller (11).

20. A roller device according to claim 19, wherein the pivot bearing (12) of the lever (10) is arranged in a substantially U-shaped support (13).

21. A roller device according to claim 19, wherein a lever arm ratio of the double-armed lever (10) is 2:3 to 1:3.

22. A roller device according to claim 19, wherein the second lever arm (18) is designed to be cranked.

23. A roller device according to claim 19, wherein the support (13) is fixed to wing rails (2,3) or to supporting structure (4,5) of the switch, and an adjustment device (20) for the spring (19) in top view is arranged outside the wing rails (2,3) or the supporting structure (4,5), respectively.

* * * * *